US011459065B2

(12) United States Patent
Moseley et al.

(10) Patent No.: US 11,459,065 B2
(45) Date of Patent: Oct. 4, 2022

(54) LOCKING DOCK CLEAT COVER

(71) Applicants: Gerald Moseley, Lakeside, CA (US); Cynthia Moseley, Lakeside, CA (US); Gavin Moseley, Lakeside, CA (US); Aidan Moseley, Lakeside, CA (US)

(72) Inventors: Gerald Moseley, Lakeside, CA (US); Cynthia Moseley, Lakeside, CA (US); Gavin Moseley, Lakeside, CA (US); Aidan Moseley, Lakeside, CA (US)

( * ) Notice: Subject to any disclaimer, the term of this patent is extended or adjusted under 35 U.S.C. 154(b) by 45 days.

(21) Appl. No.: 17/092,303

(22) Filed: Nov. 8, 2020

(65) Prior Publication Data

US 2021/0147037 A1 May 20, 2021

Related U.S. Application Data

(60) Provisional application No. 62/932,263, filed on Nov. 7, 2019.

(51) Int. Cl.
*B63B 21/04* (2006.01)

(52) U.S. Cl.
CPC ..... *B63B 21/04* (2013.01)

(58) Field of Classification Search
CPC ..... B63B 21/04
See application file for complete search history.

(56) References Cited

U.S. PATENT DOCUMENTS

| | | | | | |
|---|---|---|---|---|---|
| 4,685,500 | A * | 8/1987 | Silvia | B63B 21/045 | 206/525 |
| 5,327,844 | A * | 7/1994 | Kress | B63B 21/045 | 114/364 |
| 5,826,531 | A * | 10/1998 | Havnaer, Jr. | B63B 21/045 | D8/356 |
| 6,223,670 | B1 * | 5/2001 | Schulze | E02B 3/24 | 114/218 |
| 7,124,699 | B1 * | 10/2006 | Clark | E02B 3/20 | 114/218 |
| 9,499,236 | B1 * | 11/2016 | Arlet | B63B 21/06 | |
| 10,939,718 | B2 * | 3/2021 | Teetzel | A42B 3/0406 | |
| 2013/0152841 | A1 * | 6/2013 | Moen | B63B 21/045 | 114/218 |
| 2019/0104797 | A1 * | 4/2019 | Teetzel | A42B 3/04 | |

* cited by examiner

*Primary Examiner* — S. Joseph Morano
*Assistant Examiner* — Jovon E Hayes
(74) *Attorney, Agent, or Firm* — Michael R Shevlin

(57) ABSTRACT

The present invention relates to a cleat cover that is designed to prevent unauthorized use. The cover has a dome shaped body with an interior cavity interior configured to cover and removable attach to the cleat.

15 Claims, 2 Drawing Sheets

LOCKING DOCK CLEAT COVER

CROSS-REFERENCE TO RELATED APPLICATIONS

This application claims priority from U.S. Provisional Patent Application No. 62/939,263, filed on Nov. 7, 2019, the contents of which are incorporated herein by reference.

BACKGROUND

Field of the Invention

The present disclosure relates to a locking dock cleat cover.

Description of the Related Art

Dock cleats are used to secure a boat to dock. The dock cleat shape allows a boat line or rope to wrap. The dock cleat is usually made of metal and are often located on the edges of a dock.

FIG. 1 shows a boat 10 secured to a typical dock cleat 15 mounted on a dock 20 using a rope 25 extending between the boat 10 and the dock cleat 15. While the picture shows one rope, there may be more than one rope used, such as a bow rope and a stern rope.

The issue at hand is unauthorized use of a private dock by other boaters who are looking for a temporary parking spot for their boat. This can happen anywhere there are private docks that are not in full-time use—such as a vacation home. Typically, there are marinas in the area that will rent space to weekend boaters on a space-available basis. When the spaces are filled, or a boater does not want to spend the money to rent dock space, some of those boaters resort to parking their boats at private docks (dock squatters). They think, "those people aren't here this weekend, they won't mind". This creates a couple problems—1) the dock owner shows up afterward, and then has to deal with finding out whose boat it is so that they can get it out of there; and 2) liability issues a dock owner may be subjected to when some random person gets injured on their dock, or their boat is damaged. It is illegal to cast the boat adrift, and law enforcement is usually not very responsive about moving a boat.

A need therefore exists for improved methods and devices to prevent unauthorized use of a dock cleat so that dock squatters cannot to tie-up to the dock.

SUMMARY

The present invention is directed to a locking dock cleat cover that is applied over a dock cleat. The locking dock cleat cover is easily applied over the dock cleat and is designed to prevent unauthorized use by not allowing a rope to tie to the cleat.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Throughout the drawings, similar symbols typically identify similar components, unless context dictates otherwise. Note that the relative dimensions of the following figures may not be drawn to scale.

DETAILED DESCRIPTION

Figure 1:
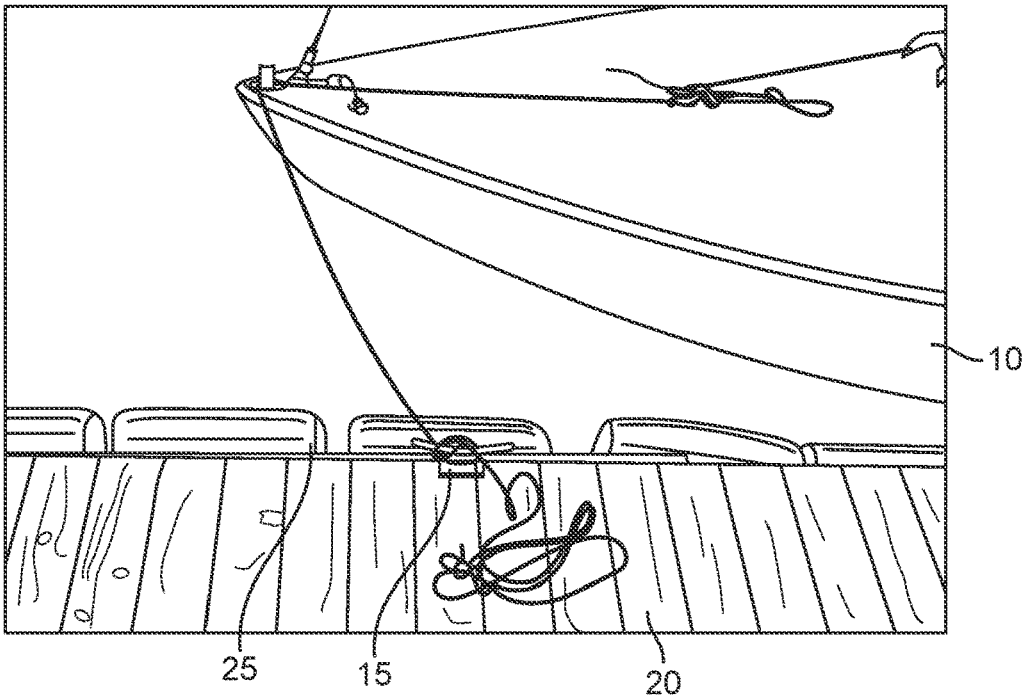
FIG. 1 shows a boat secured to a typical dock cleat.

In the following detailed description, reference is made to the accompanying drawings, which form a part of the present disclosure. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure.

"Secured" and variations thereof as used herein include methods by which an element is directly secured to another element, such as being glued, screwed, or otherwise fastened directly to, on, within, etc. another element, as well as indirect means of securing two elements together where one or more elements are disposed between the secured elements.

Figure 2:
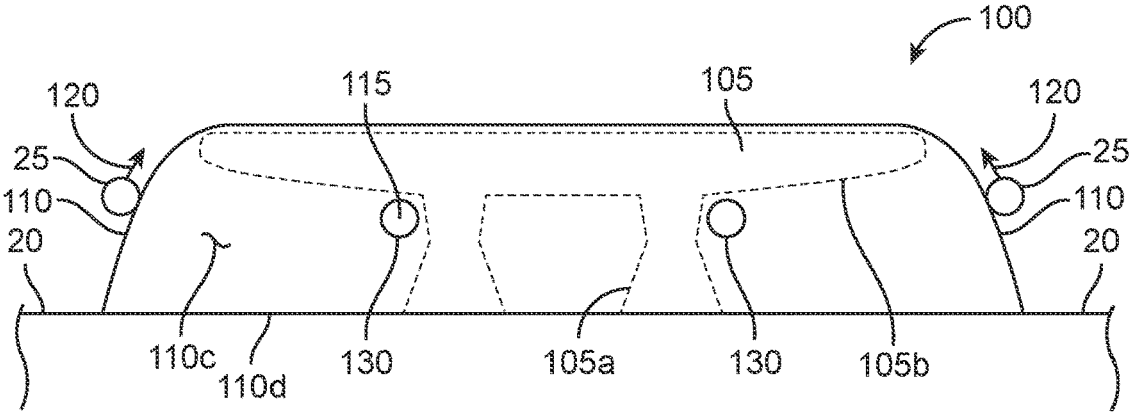
FIG. 2 is a side view showing one embodiment of a locking dock cleat cover assembly covering a dock cleat.
Figure 3:
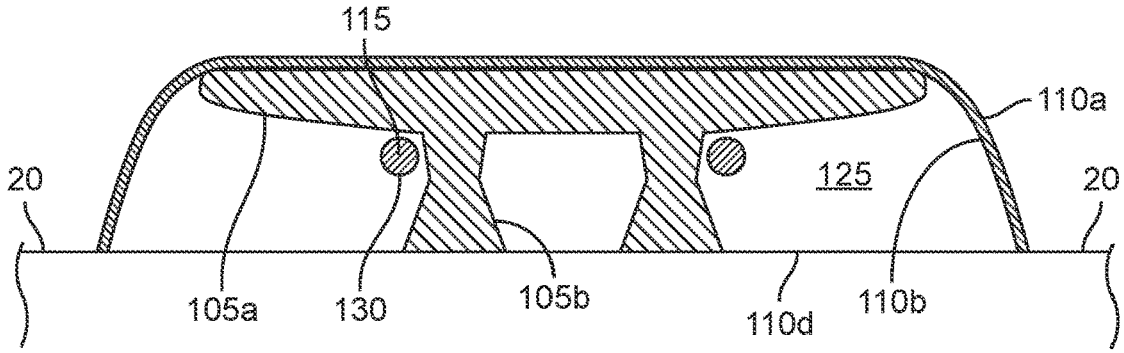
FIG. 3 is a cross-sectional view showing one embodiment of a locking dock cleat cover assembly covering a dock cleat.

FIG. 2 is a side view and FIG. 3 is a cross-sectional view of a locking dock cleat cover assembly 100 covering a dock cleat 105. The dock cleat 105 may be a conventional cleat of the kind commonly found around boats, boat docks and wharfs. The dock cleat 105 has base 105*a* and laterally extending arms 105*b* attached to base 105*a* and extend in opposite directions.

The locking dock cleat cover assembly 100 includes a locking dock cleat cover 110 with a dock cleat attachment device 115. The locking dock cleat cover 110 has a smooth outer shape and/or surface 110 that is designed to completely cover the dock cleat and prevent unauthorized use by preventing attachment of the boat line or rope 25.

The sides of the outer surface 110 may be curved, tapered and/or angled to dissuade a dock squatter from trying to tie up to the cover, by making it so that the lines slip right off. Instead of attaching to the dock cleat 105, the boat line or rope 25 will slide upward on the cover surface 110.

Figure 4A:
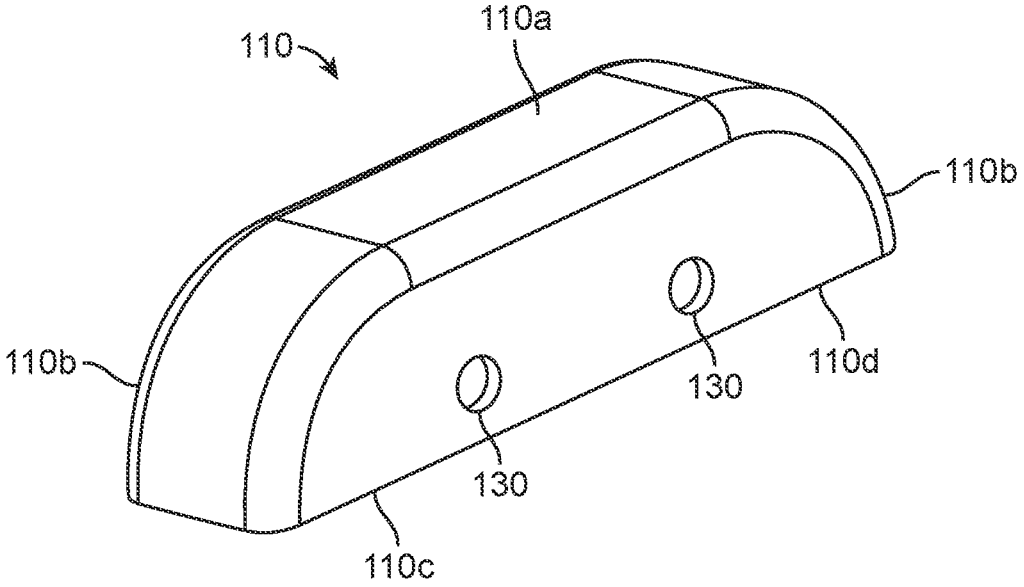
FIG. 4 are perspective views of one embodiment of a locking dock cleat cover.
Figure 4B:
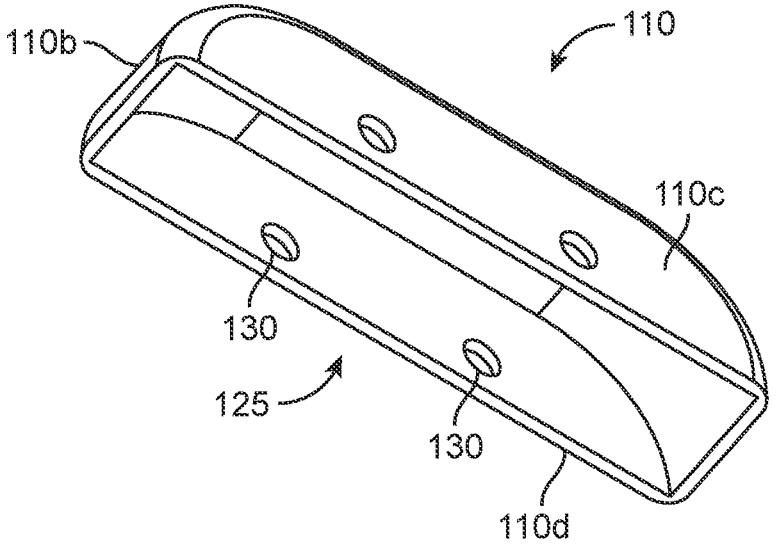

FIG. 4A is a top perspective view and FIG. 4B is a bottom perspective view of the locking dock cleat cover 110. The locking dock cleat cover 100 may be any shape that will prevent boat line or rope attachment, such as a rectangular shape having parallel sides with curved or rounded ends, or a spherical or dome shaped cover.

The locking dock cleat cover 100 includes a top or outer surface 110*a*, angled, curved and/or rounded ends 110*b*, parallel sides, 110*c*, and a lower edge 110*c* forming an interior cavity 125, that is configured to contact and/or lay against the surface of the dock 20 to which the locking dock cleat cover assembly 100 is mounted. This will prevent the boat line or rope from going under the locking dock cleat cover 100. The interior cavity 125 is sized to accommodate the dock cleat 105 including the dock cleat arms 105*a* and leg(s) 105*b*.

In some embodiments, the locking dock cleat cover 100 is made up of integral one-piece body and molded from a hard material, such as a hard plastic material or aluminum. The locking dock cleat cover 100 has relatively flat bottom 110*d* and the interior cavity 125 is sized to receive the laterally extending arms 105*b* of dock cleat 105.

Since the locking dock cleat cover 110 is exposed to the elements, the material should be durable and resistant to ultraviolet radiation. It may be desirable for the locking dock cleat cover 110 to be brightly colored let the boaters to the presence of the locking dock cleat cover 110 and that the dock cleat 105 is not usable.

The dock cleat attachment device 115 is configured to be secured to the locking dock cleat cover 110 on the dock cleat 105. In some embodiments, the dock cleat attachment device 115 includes locking bars 115*a* extending through bar holes 130 in two opposing surfaces in the cover 110. In some embodiments the locking bars 115 are cylindrical and fit through complementary round bar holes 130. In some embodiments, the bar holes 130 and locking bars 115 are threaded for attachment. In some embodiments, the bar holes 130 may be undersized and the locking bars 115 frictionally engage the bar hole 130 for attachment. In some embodiments the locking bars 115 may comprise teeth or other protrusion that drive into the bar holes 115. In some embodiments, the dock cleat attachment device 115 may be a locking cable extending through bar holes 130.

The bar holes 130 may be located on the parallel sides 110*c* and positioned under the dock cleat arms 105*b* and either side of the dock cleat legs 105*a*. Once in place, the locking bars 105*a* may engage the cleat arms 105*b* to prevent the cover 100 from being lifted off the dock cleat 115. In use, the locking dock cleat cover 110 is installable over dock cleat 105 and secured in place by cleat attachment device 115.

The locking dock cleat cover assembly 100 may be installed placing the locking dock cleat cover 110 on dock cleat 105 so that the laterally extending arms 105*b* and base 105*a* are within the internal interior cavity 125. The locking bars 115 are inserted thought the bar holes 130 and secured to the locking dock cleat cover 110. Once in place, a rope cannot be wrapped around dock cleat 105 to secure a boat.

While this invention has been described in connection with what are presently considered to be practical embodiments, it will be appreciated by those skilled in the art that various modifications and changes may be made without departing from the scope of the present disclosure. It will also be appreciated by those of skill in the art that parts mixed with one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments. With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While the present disclosure has described certain exemplary embodiments, it is to be understood that the invention is not limited to the disclosed embodiments, but, on the contrary, is intended to cover various modifications and equivalent arrangements included within the scope of the appended claims, and equivalents thereof.

What is claimed is:

1. A locking dock cleat cover assembly comprising:

a locking dock cleat cover having an outer shape with an interior cavity sized to fit a dock cleat, the outer shape being configured to prevent attachment of a boat line or rope; and a dock cleat attachment device includes locking bars extending through bar holes in surfaces in the outer shape configured to secure the locking dock cleat cover on the dock cleat; and the bar holes are positioned in two opposing surfaces in the cover under the dock cleat arms and either side of the dock cleat legs so that the locking bars may engage the cleat arms to prevent the locking dock cleat cover from being lifted off the dock cleat.

2. The locking dock cleat cover assembly of claim 1, wherein the outer shape includes a top surface, inwardly angled and/or curved ends, parallel sides with a lower edge forming the interior cavity sized to fit a dock cleat.

3. The locking dock cleat cover assembly of claim 1, wherein, the bar holes and locking bars are threaded for attachment.

4. The locking dock cleat cover assembly of claim 1, wherein the bar holes may be undersized and the locking bars frictionally engage the bar hole for attachment.

5. The locking dock cleat cover assembly of claim 1, wherein the locking bars may comprise teeth or other protrusion that drive into the bar holes.

6. The locking dock cleat cover assembly of claim 1, wherein the dock cleat attachment device may be a locking cable extending through bar holes.

7. The locking dock cleat cover assembly of claim 1, wherein the outer shape and/or surface that may be curved, tapered and/or angled so that a boat line or rope will slide upward on the smooth outer shape and slip off the locking dock cleat.

8. The locking dock cleat cover assembly of claim 1, wherein the locking dock cleat cover is rectangular shape having parallel sides with curved or rounded ends, or a spherical or dome shaped cover.

9. The locking dock cleat cover assembly of claim 1, wherein the locking dock cleat cover includes a flat bottom configured to contact and/or lay against the surface of the dock to which the locking dock cleat cover assembly is mounted.

10. A locking dock cleat cover assembly comprising:

a locking dock cleat cover having an outer shape and/or surface configured to completely cover the dock cleat to prevent attachment of a boat line or rope to the dock; and a dock cleat attachment device configured to secure the locking dock cleat cover on the dock cleat, wherein the dock cleat attachment device includes locking bars extending through bar holes in surfaces in the outer shape configured to secure the locking dock cleat cover on the dock cleat, the bar holes are positioned in two opposing surfaces in the cover under the dock cleat arms and either side of the dock cleat legs so that the locking bars may engage the cleat arms to prevent the locking dock cleat cover from being lifted off the dock cleat.

11. The locking dock cleat cover assembly of claim 10, wherein the outer shape includes a top surface, side surfaces and end surfaces with a lower edge forming an interior cavity sized to fit a dock cleat.

12. The locking dock cleat cover assembly of claim 10, wherein the outer shape may be curved, tapered and/or angled so that a boat line or rope will slide upward on the smooth outer shape and slip off the locking dock cleat.

13. The locking dock cleat cover assembly of claim 10, wherein the locking dock cleat cover is rectangular shape having parallel sides with curved or rounded ends, or a spherical or dome shaped cover.

14. The locking dock cleat cover assembly of claim 10, wherein the locking dock cleat cover includes a flat bottom configured to contact and/or lay against the surface of the dock to which the locking dock cleat cover assembly is mounted.

15. A locking dock cleat cover assembly comprising:

a locking dock cleat cover having an outer shape with an interior cavity sized to fit a dock cleat, wherein the outer shape may be curved, tapered and/or angled with a flat bottom so that a boat line or rope will slide upward on the smooth outer shape and slip off the locking dock cleat, and the flat bottom being configured to contact and/or lay against the surface of the dock to which the locking dock cleat cover assembly is mounted; and a dock cleat attachment device configured to secure the locking dock cleat cover on the dock cleat, wherein the dock cleat attachment device includes locking bars extending through bar holes positioned in two opposing surfaces in the cover under the dock cleat arms and either side of the dock cleat legs so that the locking bars may engage the cleat arms to prevent the locking dock cleat cover from being lifted off the dock cleat.

* * * * *